United States Patent [19]

Morgan

[11] Patent Number: 4,763,364

[45] Date of Patent: Aug. 16, 1988

[54] SHAMPOO BOWL NECK CUSHIONING DEVICE

[76] Inventor: Millie D. Morgan, 220 South St., Chagrin Falls, Ohio 44022

[21] Appl. No.: 37,035

[22] Filed: Apr. 10, 1987

[51] Int. Cl.[4] ..... A45D 44/10

[52] U.S. Cl. ..... 4/523; 4/515; 4/519

[58] Field of Search ..... 4/515–523; 132/7

[56] References Cited

U.S. PATENT DOCUMENTS

| | | | |
|---|---|---|---|
| 2,161,590 | 6/1939 | Rickard | 4/523 |
| 2,261,476 | 11/1941 | Kiefer | 4/519 |
| 2,948,903 | 8/1960 | Gilmer | 4/523 |
| 4,327,452 | 5/1982 | Swatzell | 4/523 |
| 4,385,408 | 5/1983 | Rhodes | 4/523 |
| 4,649,580 | 3/1987 | Bastien | 4/519 |

*Primary Examiner*—Henry K. Artis

*Attorney, Agent, or Firm*—Fay, Sharpe, Beall, Fagan, Minnich & McKee

[57] ABSTRACT

A neck cushioning device for engagement with hair shampoo bowls. The cushioning device is comprised of a cushion of resilient material coated with a flexible, water-repellent substance over the entire surface. The cushioning device is adaptable to over-lay the U-shaped neck-receiving notch found on a commercial shampoo bowl and to wrap laterally around the edges of the notch for engagement therewith by means of downwardly projecting walls, one of which includes a protruding lip that curls around the notch and secures the cushioning device to the bowl.

6 Claims, 2 Drawing Sheets

SHAMPOO BOWL NECK CUSHIONING DEVICE

BACKGROUND OF THE INVENTION

This invention pertains to barber shop and beauty parlor equipment and more particularly to a cushion to cover the neck-receiving, U-shaped notch in a shampoo bowl conventionally found in such locations, thus protecting the neck of a patron from the hard surface of the notch.

Various devices are known in the art for cushioning the neck of a barber shop or beauty parlor patron from the hard surface of the sink bowl while the patron is having his or her hair shampooed. Five such devices are disclosed in U.S. Pat. No. 2,161,590 issued to Rickard; U.S. Pat. No. 2,948,903 issued to Gilmer; U.S. Pat. No. 327,452 issued to Swatzell; U.S. Pat. No. 4,385,408 issued to Rhodes; and U.S. Pat. No. 4,411,032 issued to Lewy.

The devices disclosed in these patents include neck rests for use at home (U.S. Pat. No. 2,161,590), neck rests for use on the flat surface of a sink bowl (U.S. Pat. No. 4,327,452), and neck rests for use with neck receiving notches commonly found on commercial shampoo bowls (U.S. Pat. Nos. 2,948,903; 4,385,408; 4,411,032). The latter patents disclose a neck rest with a detachable water-resistant cover (U.S. Pat. No. 4,385,408), a neck rest that fastens to the neck of the user (U.S. Pat. No. 4,411,032), and a neck rest with multiple layers bonded together so as to cushion the neck of the user while simultaneously preventing the neck rest from becoming saturated with water.

The plethora of neck protection devices extant in the art is testament to the degree to which customers of beauty parlors and barber shops wish to have the backs of their necks protected from the hard surfaces of shampoo bowls. Proprietors of barber shops and beauty parlors are anxious to accommodate their patrons' wishes in this regard, but desire to do so using an inexpensive, simple to use, readily sanitized, and reusable device, if possible.

A significant problem that accompanies the use of neck protection devices in conjunction with shampoo bowls is that they easily become fowled with various chemical preparations used in the treatment and styling of hair. This inventor has found that if a neck rest is capable of absorbing water, it will become stained from these chemical preparations after minimal use, even if careful attention is paid to cleaning the device after each use.

Accordingly, a primary object of the present invention is to provide an inexpensive water-repellent neck cushioning device to protect the neck of a barber shop or beauty parlor patron from the hard surface of a particular style shampoo sink, that being a sink in which the bowl walls do not contain extensive horizontal surfaces projecting outwardly from the top thereof, but rather contain U-shaped neck-receiving notches typically located on the front of the bowl.

A further object of the present invention is to provide a neck cushion which is effective, simple to use, and easily removable.

BRIEF SUMMARY OF THE INVENTION

In accordance with the present invention, there is provided a neck cushioning device adapted to overlie the U-shaped, neck-receiving notch provided in the front wall of shampoo bowls. The neck cushioning device is generally comprised of resilient material coated with a flexible, water-repellent substance over its entire surface. The cushioning device conforms to the contours of the U-shaped notch and is held in place on the notch by a portion of the cushioning device, which projects down and curls around the lower edge of the notch by means of an inwardly projecting lip.

BRIEF DESCRIPTION OF THE DRAWINGS

A preferred embodiment of the present invention is described with reference to the accompanying drawings wherein.

DETAILED DESCRIPTION OF THE INVENTION

Figure 1:
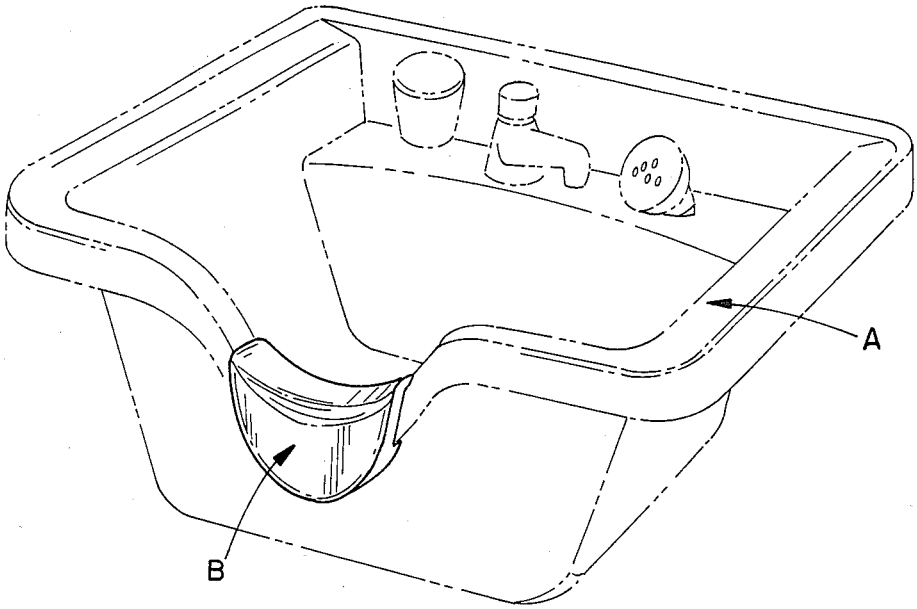
FIG. 1 is a perspective view of the preferred embodiment of the cushioning device arranged over the U-shaped notch in the shampoo bowl.
Figure 4:
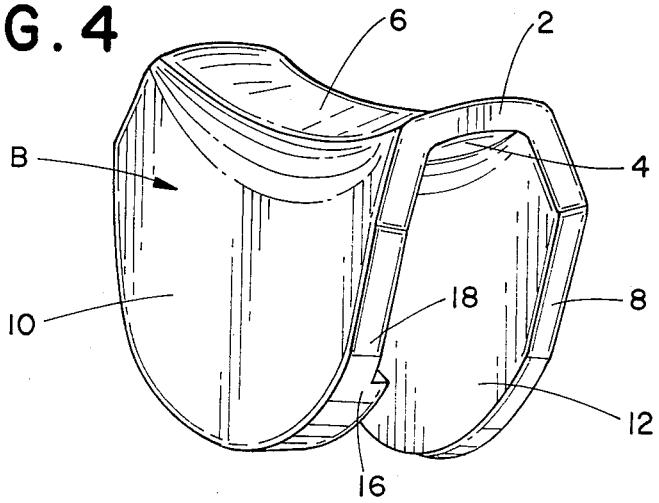
FIG. 4 is a second perspective view of the cushioning device.
Figure 5:
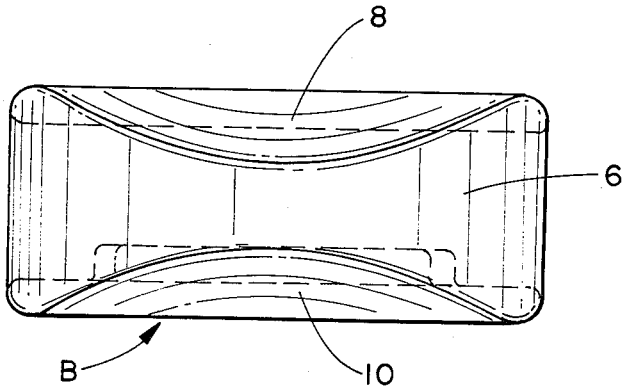
FIG. 5 is a top view of the cushioning device.

Referring now to the drawings wherein the showings are for purposes of illustrating the preferred embodiment of the invention only and not for purposes of limiting same, the Figures show a device to cushion and protect the neck of a patron from the hard surface of a shampoo bowl comprised of a cushion of resilient material coated with a flexible, water-repellent material over its entire surface and adapted to engage the neck-receiving notch of the shampoo bowl.

Figure 2:
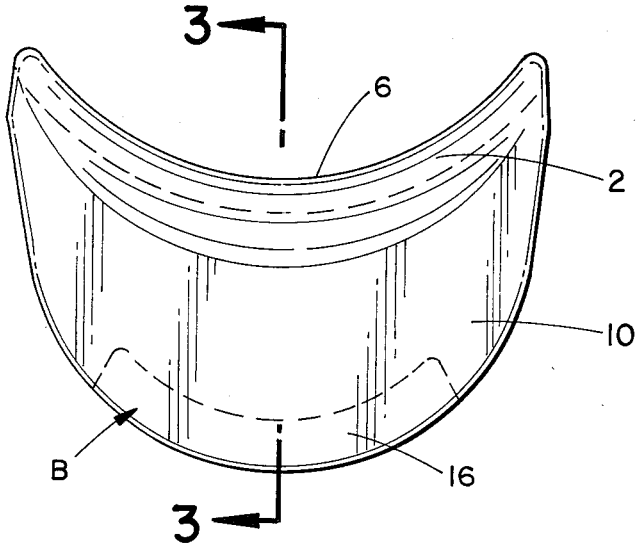
FIG. 2 is a side view of the cushioning device.

More specifically and with reference to FIGS. 1 and 2, the device is comprised of an elongated cushion of resilient material B coated with a flexible, water-repellent material over its entire surface, and adapted to overlie the U-shaped neck-receiving notch in a shampoo bowl A as illustrated in FIG. 1. The cushion B is of a generally elongated shape having a first, neck-supporting top wall portion 2 adapted to overlie the U-shaped neck-receiving notch in the front wall of a shampoo bowl. The first portion is sized to support the rear neck portion of a patron centrally located thereon, it has a downwardly deflecting, arcuate shape such that the lower surface 4 of the first portion is in intimate contact with the upper surface of the notch in the shampoo bowl, and the upper surface 6 of the first portion is in intimate contact with a patron's neck when in use.

Figure 3:
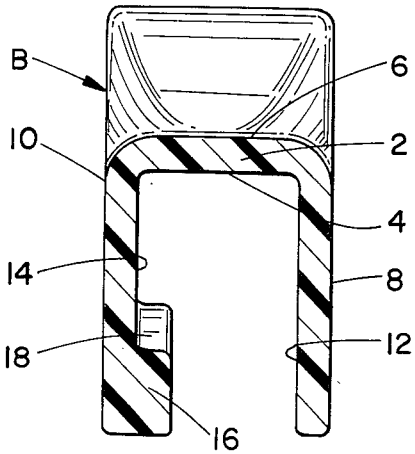
FIG. 3 is a sectional view of FIG. 2.

The cushioning device is provided with second 8 and third 10 side wall portions integrally connected to and depending from the first portion 2. The second, sidewall portion 8, which is also composed of a resilient material, projects downward from the first portion 2 normal thereto in the sectional plane (FIG. 3), has a generally arcuate shape somewhat more extended than the arcuate shape of the first portion, and is shaped to overlie the forwardmost inner bowl surface, such that the interior surface 12 of the second sidewall portion 8 is in intimate contact with the inner bowl surface.

A third forwardmost side wall portion 10 is also integrally connected to the first portion 2, and projects downward therefrom in a manner similar to the second portion 8. The third portion 10 has a shape identical to that of the second portion 8, except that it is provided with a protruding lip 16 extending inward from the third position 10 at its most distal point, situated so as to curl under the U-shaped notch in the front wall of the shampoo bowl for opposite disposition about the notch from the top wall portion 2 and thereby bring the interior surface 14 of the third sidewall portion 10 into intimate contact with the forwardmost outer surface at the U-shaped notch, and thereby lock the device into place. The third side wall portion 10 thus resiliently depends from the top wall portion 2 so that it is urged towards the bowl A so that the top wall portion 2, side wall portion 10 and lip 16 closely engage the bowl notch. The lip 16 includes an arcuately configured top wall 18 disposed for mating engagement against the bowl side wall notch to further facilitate securing the cushioning device to the bowl.

The invention has been described with reference to the preferred embodiment. Obviously, modifications and alterations will occur to others upon reading and understanding of the specification. This is particularly true of the configuratin of the device; other configurations will be apparent to those skilled in the art. It is the inventor's intention to include all such modifications, alterations, and alternate configurations in so far as they come within the scope of the appended claims or the equivalence thereof.

Having thus described my invention, I now claim:

1. A neck cushioning device adapted for attachment to a shampoo bowl having a U-shaped, neck-receiving notch in the front wall of the bowl, said neck cushioning device comprising a framework of resilient material coated with a flexible, water-repellent coating over its entire surface;

said framework including:

a first, neck-supporting portion adapted to overlie a segment of the U-shaped, neck-receiving notch in the shampoo bowl and having a downwardly deflecting notch at the center, arcuately shaped such that the lower surface of the first portion is in intimate contact with the upper surface of the notch in the shampoo bowl;

a second portion integrally connected to the first portion, downwardly projecting therefrom, and sized to overlie a portion of the forwardmost inner bowl surface adjacent the notch; and, a third portion integrally connected to the first portion, downwardly projecting therefrom, and having a lip sized to curl inwardly under the notch in said front wall and so secure the device to the bowl.

2. An apparatus in accordance with claim 1 wherein said framework is composed of closed-cell vinyl foam.

3. A hair shampoo neck cushion, of resilient material coated with a flexible water repellent coating, for supporting a neck positioned at a shampoo bowl for hair washing wherein the bowl has a sidewall notch sized for receiving the neck, the cushion comprising:

a neck supporting top wall configured for mating reception adjacent the sidewall notch;

opposed cushion forward and back side walls depending from the top wall, said forward side wall overlying a portion of the bowl, said back side wall having a protruding lip disposed for curling under the bowl sidewall notch and securing the cushion to the bowl.

4. The neck cushion as defined in claim 3 wherein the back wall resiliently depends from the top wall and said lip is disposed at a back wall distal end whereby the lip is urged towards the bowl.

5. The neck cushion as defined in claim 4 wherein said lip includes a lip top wall surface configured for mating engagement against the side wall notch, said lip and said cushion top wall thereby being disposed oppositely about the bowl notch.

6. The neck cushion as defined in claim 5 wherein the lip top wall surface is spaced from a neck supporting top wall lower surface a distance generally equivalent to a transversal dimension of the bowl side wall notch whereby the head cushion is closely engaged about the bowl notch.

* * * * *